United States Patent [19]

Baker

[11] Patent Number: 4,628,547

[45] Date of Patent: Dec. 16, 1986

[54] APPARATUS FOR CONTAINMENT OF ORAL SECRETIONS

[76] Inventor: Walter D. Baker, 5401 Holly Cir., Raleigh, N.C. 27603

[21] Appl. No.: 754,246

[22] Filed: Jul. 12, 1985

[51] Int. Cl.[4] ..... A61J 19/02

[52] U.S. Cl. ..... 4/259

[58] Field of Search ..... 4/259, 258, 260, 265, 4/266, 285, 280, 271, 267; 141/344, 345; 222/487, 488, 517, 508; 220/90.4, 288

[56] References Cited

U.S. PATENT DOCUMENTS

| | | | |
|---|---|---|---|
| 57,494 | 8/1866 | Fuller | 141/345 |
| 71,887 | 12/1867 | Knowlton | 222/487 |
| 169,576 | 11/1875 | Peterson | 222/508 |
| 281,189 | 7/1883 | Jackson | 222/487 |
| 445,127 | 1/1891 | Rand | 222/508 |
| 630,225 | 8/1899 | Hodgerney | 4/259 |
| 656,000 | 8/1900 | Wall | 222/487 |
| 669,984 | 3/1901 | Federmann | 4/265 |
| 768,355 | 8/1904 | Bolen | 222/508 |
| 954,346 | 4/1910 | Romero | 141/344 |
| 1,003,047 | 9/1911 | Iruz | 141/344 |
| 1,555,176 | 9/1925 | Allen | 222/508 |
| 2,349,985 | 5/1944 | Page | 4/271 |
| 2,965,907 | 12/1960 | Ropelato | 4/259 |
| 3,097,674 | 7/1963 | Allen | 222/508 |
| 3,739,938 | 6/1973 | Paz | 220/90.4 |

FOREIGN PATENT DOCUMENTS

| | | | |
|---|---|---|---|
| 440504 | 7/1912 | France | 4/271 |

*Primary Examiner*—James E. Bryant, III
*Assistant Examiner*—L. J. Peters
*Attorney, Agent, or Firm*—Mills and Coats

[57] ABSTRACT

The present invention is a pocket cuspidor which is simple, sanitary and convenient for containerizing oral secretions. Tobacco juice, spitum and other oral secretions are expectorated through a mouthpiece into a small portable container. Pressing a thumb tab simultaneously opens a mouthpiece valve and a vent valve, allowing spitum to enter the container and air, displaced by spitum, to escape. Releasing the thumb tab closes both valves, sealing the container. The small sealed container may be carried conveniently in clothing and handbags. The apparatus includes a container and removable top.

2 Claims, 4 Drawing Figures

APPARATUS FOR CONTAINMENT OF ORAL SECRETIONS

FIELD OF INVENTION

The present invention relates to spittoons, cuspidors, and more particularly to pocket cuspidors.

BACKGROUND OF INVENTION

Individuals who chew tobacco or use snuff are severely restricted from chewing or using tobacco because of a lack of a convenient means into which the tobacco juices and other associated secretions can be disposed. This is especially true when these individuals find themselves in and around public places and facilities.

Portable cuspidors have been used and proposed for this very purpose. For example, see the disclosures found in U.S. Pat. Nos. 630,225; 1,012,471; 2,965,907 and 4,162,547. Although portable cuspidors of the prior art have been designed in various shapes and sizes, they have not been practical, easy to handle and use. In fact they have been unsatisfactory in terms of size, performance, convenience, method of operation and cost. One very important shortcoming of portable cuspidors of the prior art is that they have often been too complicated and have involved many moving parts which has naturally made them being quite expensive. Moreover, many types of cuspidors previously used have simply been very difficult to use in a sanitary manner.

Therefore, there has been and continues to be a need for a practical and portable cuspidor that can be easily and conveniently carried and used by an individual who chooses to use nonsmoking tobacco.

SUMMARY AND OBJECTS OF INVENTION

The present invention overcomes the aforementioned deficiencies of the prior art. The cuspidor of the present invention includes a container and a screw-on top. The container includes a base and a surrounding wall structure that extends up from the base. Formed about the upper portion of the container is an open top that entails a mouth with a threaded flange. The top is formed to mate with the container's threaded flange and incorporates a mouthpiece passing therethrough and into the container. A plate valve on the container side of the top blocks the mouthpiece passageway until a thumb tab on the top is depressed. Pressing the thumb tab simultaneously opens the mouthpiece for the introduction of spitum and a vent from the inside of the container to the outside.

Releasing the thumb tab closes all passageways and seals the entire cuspidor until depressed again. Thus sealed, the cuspidor may be carried in any convenient manner.

Disposal of the contents is simply a matter of unscrewing the container from the top and flushing with water. This straightforward design provides for ease of maintenance.

It is, therefore, an object of the present invention to provide a cuspidor that can be easily and conveniently carried on the person.

A further object of the present invention is to provide a portable flask-like cuspidor that enables a person chewing tobacco or otherwise using tobacco such as snuff to be able to dispose of tobacco juices in a clean and sanitary manner.

Still a further object of the present invention resides in the provision of a portable flask-type cuspidor of the type referred to above that is of a two-piece construction and includes a removable top that enables the cuspidor to be emptied and cleaned very efficiently.

Another object of the present invention resides in a portable flask-type cuspidor that includes an hand-actuated valve for opening and closing a mouthpiece that is directed into the cuspidor so as to selectively open and seal the cuspidor when desired.

It is also an object of the present invention to provide a flask-type cuspidor of the type referred to above that is simple in design and which has relatively few moving parts associated with its valve structure.

Another object of the present invention resides in the provision of a portable flask-like cuspidor of the character referred to above that is easy to operate but which is designed so as to maintain a relatively tight seal so as to contain and confine tobacco juices within the cuspidor while the same is carried on the person.

Other objects and advantages of the present invention will become apparent from a study of the following description and the accompanying drawings which are merely illustrative of such invention.

DETAILED DESCRIPTION OF THE INVENTION

With reference to the drawings, the apparatus of the present invention for containment and transportation of tobacco juice, spitum and oral secretions is shown therein and indicated generally by the numeral 10.

Reviewing apparatus 10 in detail, it is seen that the apparatus includes a container 40 and a removable top 50. Container 40 could be constructed of metal, plastic or any suitable material.

Figure 1:
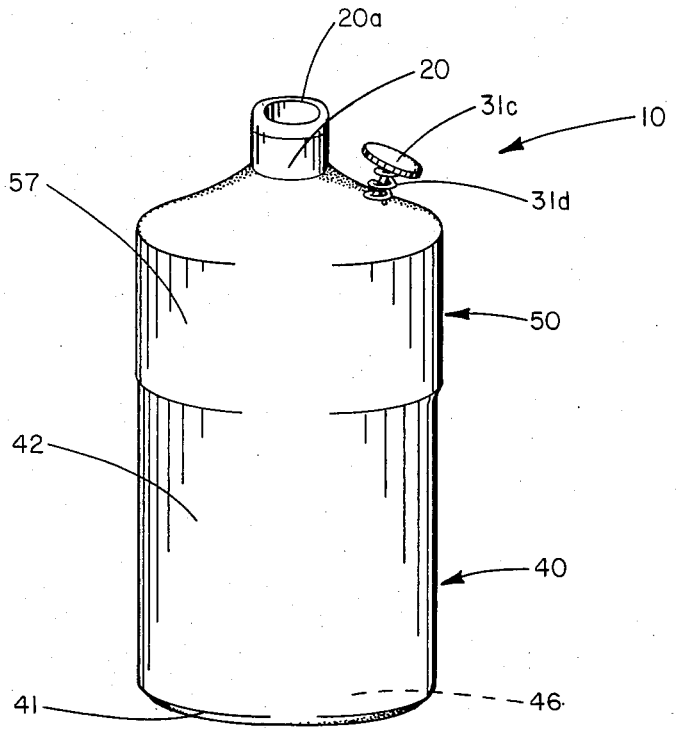
FIG. 1 is a perspective view of the entire apparatus as viewed from the front.
Figure 2:
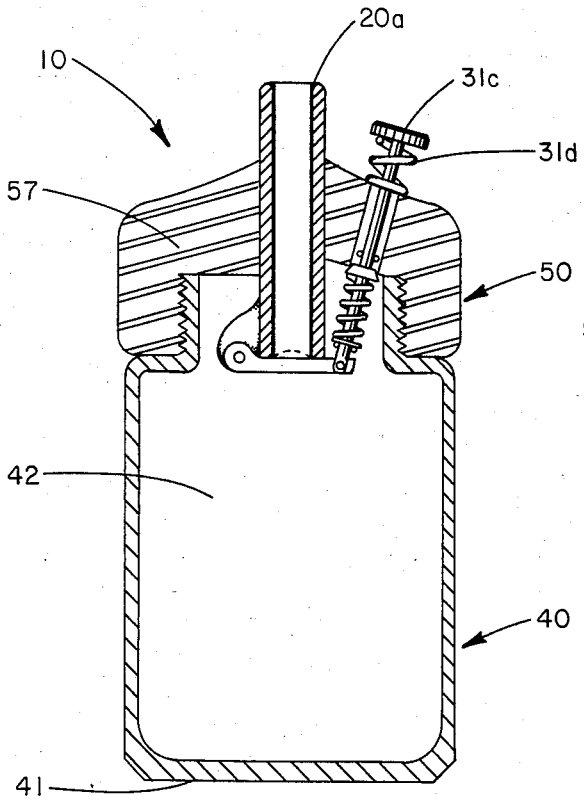
FIG. 2 is a side sectional view of the apparatus of the present invention.
Figure 3:
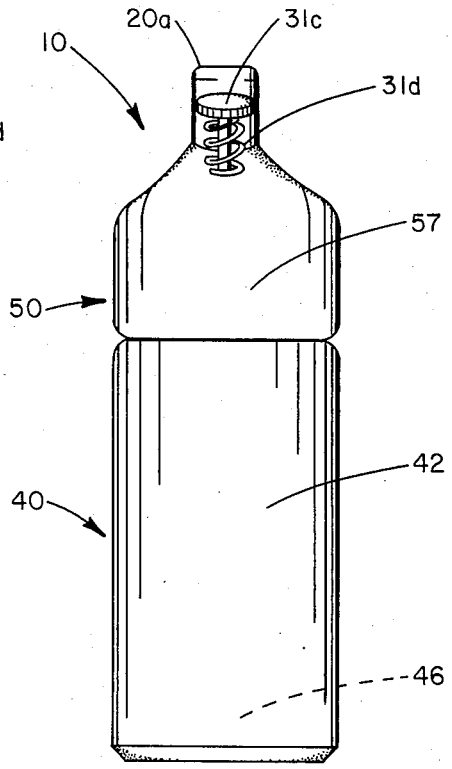
FIG. 3 is an end view of the apparatus of the present invention.
Figure 4:
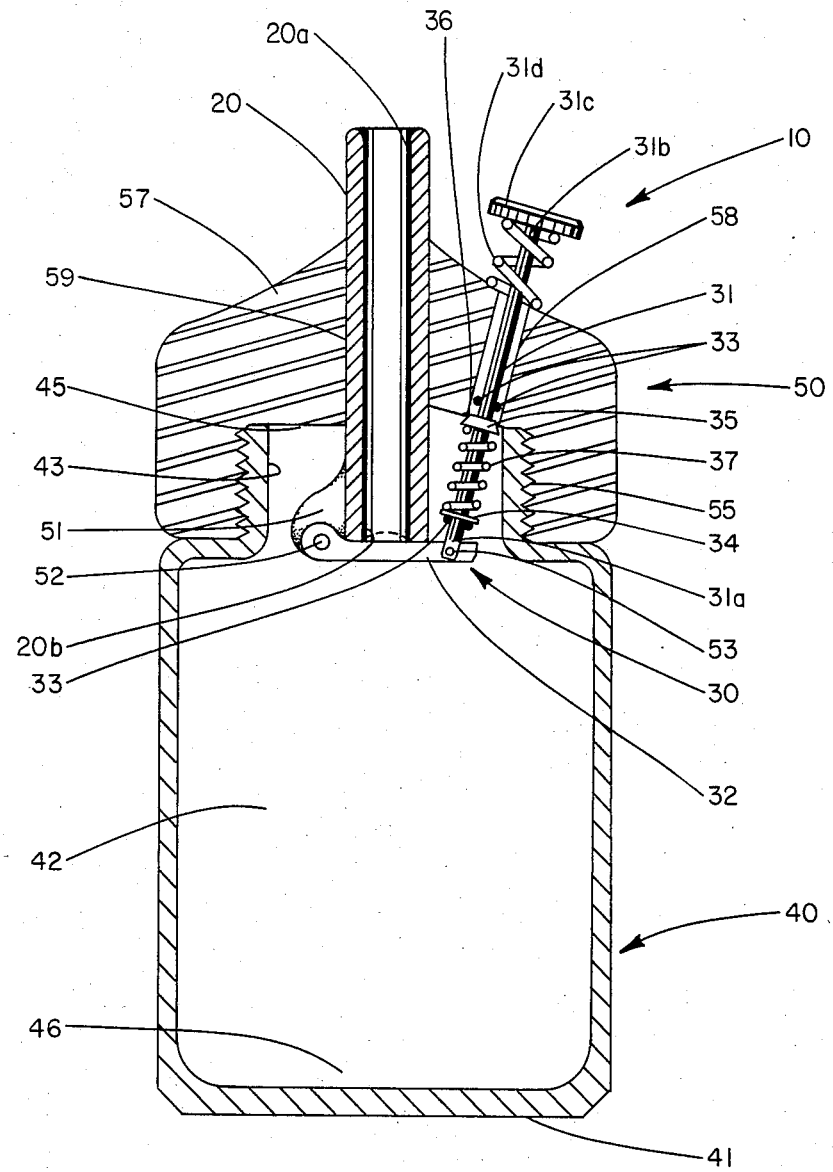
FIG. 4 is an enlarged sectional view similar to that shown in FIG. 2.

Container 40 includes a base 41, container side walls 42 and a container mouth 43. The container mouth 43 is formed to a bottleneck shape terminating in a cylindrical structure. The top outside edge of the cylindrical mouth structure is threaded to mate with identical threads formed in top 50. About the top portion of the container mouth is formed an entry area 45 (FIG. 4). The entire volume enclosed by the container base 41, container walls 42, container mouth 43 and the container entry area 45 constitutes a collection area 46.

Detachably secured to the container is the top 50. The top 50 includes a housing 57. Incorporated into the housing 57 are a mouthpiece 20 and a valve assembly 30.

Top housing 57 includes a threaded bore 55 of the same diameter and thread size as the threads that extend around mouth 43. On the same central axis as the threaded bore 55, a mouthpiece bore 59 of smaller diameter than the container entry area 45, extends through the top housing 57. A vent bore 58 accomodates the valve assembly 30.

A mouthpiece 20 of the same diameter as the same smaller bore 59 is pressed through the housing 57 and protrudes from both sides of the bore. Mouthpiece 20 includes an inlet 20*a* and an outlet 20*b*. In the present invention, mouthpiece 20 is press fitted into bore 59, firmly securing the mouthpiece 20 within mouthpiece bore 59. Outlet end 20*b* is pressed into the top housing 57 so that the outlet extension protrudes into the container 40 when top 50 is screwed onto the container 40.

Welded or otherwise secured adjacent to the outlet end 20*b* of mouthpiece 20 is a flange 51. The flange 51 and the vent bore 58 provide attachment areas for the valve assembly 30.

Valve assembly 30 includes a plate type flapper valve 32 hinged by a flapper valve pin 52 at the flange 51 and aligned to seat over the mouthpiece outlet 20*b*. Inserted through the vent bore 58 and pinned by an actuating rod pin 53 to the flapper valve 32 is an actuating rod 31.

Actuating rod 31 includes a lower pin end 31*a* and a tab end 31*b* bonded to a thumb tab 31*c*. Between thumb tab 31*c* and the top housing 57 is a retraction spring 31*d* for biasing the actuating rod 31 to an upper position so as to move the flapper valve 32 over the outlet end 20*b* of the mouthpiece 20 to a closed position.

The valve assembly 30 includes a vent valve system including a valve 35 and vent valve seat 36 formed in the housing 57. The vent valve 35 in the present embodiment is made of neoprene but could be made of any suitable material and circumferentially surrounds the actuating rod 31 and is adapted to slide back and forth along the rod axis. Stops 33 are crimped on the actuating rod 31 at the actuating rod pin end 31*a* and again above the vent valve seat 36. Between said crimped stops 33 and said vent valve 35, the actuating rod 31 passes through a washer 34 and a vent valve spring 37. Vent valve spring 37 exerts less force than the retraction spring 31*d*.

To operate the apparatus of the present invention, one depresses thumb tab 31*c* and expectorate into the mouthpiece inlet 20*a*. Depressing the thumb tab 31*c* simultaneously opens both the flapper valve 32 on the mouthpiece outlet 20*b* via the actuating rod 31 and opens the vent valve 35 via the crimped stops 33 moving the vent valve 35 off of the vent valve seat 36. The expectorate enters the collection area 46 via the mouthpiece outlet 20*b*, passing the open flapper valve 32 and via this passageway accumulates at the base of the collection area. Displaced air is exhausted from the container 40 via the passageway between the actuating rod 31 and the vent bore 58 passing between the vent valve 35 and vent valve seat 36.

Releasing the thumb tab 31*d* allows the retraction spring 31*d* to move the actuating rod 31 toward the outside of the container. Moving with the crimped stops 33 is the vent valve 35 which is held against the valve seat 36 by the vent valve spring 37. The actuating rod 31 continues moving out of the vent bore 58 moving the flapper valve 32 to a closed position. Flapper valve 32 may be provided with an inside felt liner or the like in order to assist in creating an effective seal with outlet end 20*b* of mouthpiece 20. The apparatus is now sealed and is easily transported and even carried by the person. The container 40 may be unscrewed from the container top 50 and emptied and cleaned.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A flask-type pocket cuspidor comprising:

A. a container including a bottom, side walls and an open top;

B. a top removably mounted to the open top of said container;

C. means for transferring spitum directly from the user's mouth into said contaienr, said transfer means including an elongated tube-like mouthpiece extending through said top, said tube-like mouthpiece including an outlet end disposed within said container and an inlet end disposed exteriorly thereof adapted to be placed against the user's mouth;

D. a flapper valve pivotally connected to said outlet end of said mouthpiece for closing the same, said flapper valve being movable between a closed position with respect to said outlet end and an open position;

E. a passageway extending through said top and communicating between the interior and exterior of said container for venting said interior while spitum is being directed through said mouthpiece;

F. a poppet type valve seated against the inner end of said passageway, said poppet valve being movable between a closed position with respect to said passageway and an open position;

G. hand-actuating means operatively connected with said flapper valve and said poppet valve for moving the same from said closed positions to said open positions, said hand actuating means including an actuating rod pivotally secured to said flapper valve and extending through said passageway for moving said flapper valve and said poppet valve from said closed positions to said open positions when said actuating rod is pressed and spring means for urging said flapper and poppet valves back to a closed position whe said hand-actuating means is released, said actuating rod having a diameter lesser than said passageway such that air may freely pass through said passageway.

2. The flask type pocket cuspidor of claim 1 wherein said actuating means further comprises stop means secured to said actuating rod for engaging said poppet type valve and moving the same to an open position as said actuating rod is pressed downwardly.

* * * * *